US006994520B2

(12) United States Patent
Humanchuk et al.

(10) Patent No.: US 6,994,520 B2
(45) Date of Patent: Feb. 7, 2006

(54) INTERNAL CORE PROFILE FOR A TURBINE NOZZLE AIRFOIL

(75) Inventors: David John Humanchuk, Simpsonville, SC (US); Curtis John Jacks, Greenville, SC (US); Robert W. Coign, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 10/853,240

(22) Filed: May 26, 2004

(65) Prior Publication Data

US 2005/0265829 A1 Dec. 1, 2005

(51) Int. Cl.
*F01D 9/06* (2006.01)

(52) U.S. Cl. ..... 415/191; 415/208.2; 415/210.1; 415/115

(58) Field of Classification Search ..... 415/115–116, 415/191, 208.1, 208.2, 209.4, 210.1, 211.2; 416/96 R, 96 A, 97 R, 223 R, 223 A, 232, 416/233, 243, DIG. 2, DIG. 5
See application file for complete search history.

(56) References Cited

U.S. PATENT DOCUMENTS 5,980,209 A * 11/1999 Barry et al. ..... 416/223 A
6,722,851 B1 * 4/2004 Brittingham et al. ..... 416/96 R
6,761,535 B1 * 7/2004 McGrath et al. ..... 416/97 R
6,893,210 B2 * 5/2005 Zhang et al. ..... 415/116

* cited by examiner

*Primary Examiner*—Christopher Verdier
(74) *Attorney, Agent, or Firm*—Nixon & Vanderhye P.C.

(57) ABSTRACT

First stage nozzle airfoils have internal core profiles substantially in accordance with Cartesian coordinate values of X, Y and Z set forth in Table I wherein X, Y and Z values are in inches. The X and Y values are distances which, when connected by smooth continuing arcs, define internal core profile sections at each radial distance Z. The profile sections at each distance Z are joined smoothly to one another to form a complete internal core profile. The X, Y and Z distances may be scalable as a function of the same constant or number to provide a scaled-up or scaled-down internal core profile. The nominal internal core profile given by the X, Y and Z distances lies within an envelope of ±0.030 inches in directions normal to any internal core surface location.

13 Claims, 2 Drawing Sheets

INTERNAL CORE PROFILE FOR A TURBINE NOZZLE AIRFOIL

The present invention relates to a nozzle airfoil of a stage of a gas turbine and particularly relates to a first stage turbine nozzle airfoil internal core profile.

Many system requirements must be met for each stage of the hot gas path section of a gas turbine in order to meet design goals. Particularly, the nozzle segments of the first stage of the turbine section must meet the operating requirements for that particular stage and also meet requirements for nozzle airfoil cooling flow efficiency, life and wall thickness distribution.

BACKGROUND OF THE INVENTION

In accordance with a preferred embodiment of the present invention, there is provided a unique internal core profile for a nozzle airfoil of a gas turbine, preferably the first stage nozzle, which enhances the performance of the gas turbine. It will be appreciated that the external shape of the nozzle airfoil improves its interaction with the buckets forming the stages of the turbine. Concomitantly the internal core profile shape of the nozzle airfoil is also significant for structural reasons as well as to optimize internal cooling with appropriate wall thickness. The nozzle airfoil internal core profile is defined by a unique loci of points which achieve the necessary structural and cooling requirements whereby improved turbine performance is obtained. This unique loci of points define the internal nominal core profile and are identified by the X, Y and Z Cartesian coordinates of Table I which follows. The 1,200 points for the coordinate values shown in Table I are for a cold, i.e., room temperature nozzle airfoil at various cross-sections of the nozzle airfoil along its length. The positive X, Y and Z directions are axial toward the exhaust end of the turbine, tangential in the direction of engine rotation looking aft and radially outwardly toward the outer platform, respectively. The X and Y coordinates are given in distance dimensions, e.g., units of inches, and are joined smoothly at each Z location to form a smooth continuous internal core profile cross-section. The Z coordinates are given in inches in distances along radii from the turbine axis. Each internal core profile section in the X, Y plane is joined smoothly with the adjacent profile sections in the Z direction to form, using the Table I coordinate values, the complete internal nozzle airfoil core profile.

Table I provides coordinate values for the complete internal core airfoil shape passing through the inner and outer platforms and the airfoil therebetween. The physical shape of the internal core profile between the inner and outer platforms is given in Table I by the airfoil sections defined between Z value limits of 22.200 and 25.050.

It will be appreciated that as each nozzle airfoil heats up in use, the internal core profile will change. Thus, the cold or room temperature profile is given by the X, Y and Z coordinates for manufacturing purposes. Because a manufactured internal nozzle airfoil core profile may be different from the nominal profile given by the following table, a distance of ±0.030 inches from the nominal profile in a direction normal to any surface location along the nominal profile defines a profile envelope for this internal nozzle airfoil core profile. The profile is robust to this variation without impairment of the mechanical cooling and aerodynamic functions of the airfoil.

In accordance with a preferred embodiment of the present invention, there is provided a turbine nozzle segment including inner and outer platforms and an airfoil extending between the platforms, the airfoil having an internal nominal core profile at least a portion of which is substantially in accordance with Cartesian coordinate values of X, Y and Z set forth in Table I between Z value limits of 22.200 and 25.050, wherein the Z values between the limits are radial distances from a turbine axis to planes extending normal to the radii and wherein the X and Y values are distances in inches which, when connected by smooth continuing arcs, define internal core profile sections at each distance Z along the airfoil between said Z value limits, the profile sections at the Z distances between the limits being joined smoothly with one another to form the airfoil internal core profile.

In accordance with a further embodiment of the present invention, there is provided a turbine comprising a plurality of nozzle segments arranged in a circumferential array about an axis of the turbine, each nozzle segment including inner and outer platforms and at least one airfoil extending between the platforms, each airfoil having an internal nominal core profile at least a portion of which is substantially in accordance with Cartesian coordinate values of X, Y and Z set forth in Table I between Z value limits of 22.200 and 25.050, wherein said Z values between the limits are radial distances from a turbine axis to planes extending normal to the radii and wherein the X and Y values are distances in inches which, when connected by smooth continuing arcs, define internal core profile sections at each distance Z along the airfoil between the Z value limits, the profile sections at the Z distances between the limits being joined smoothly with one another to form the airfoil internal core profile.

In accordance with a further embodiment of the present invention, there is provided a turbine nozzle segment including inner and outer platforms and an airfoil extending between the platforms, the airfoil having an internal nominal core profile substantially in accordance with Cartesian coordinate values of X, Y and Z set forth in Table I wherein the Z values are radial distances from a turbine axis to planes extending normal to the radii and wherein the X and Y values are distances in inches which, when connected by smooth continuing arcs, define internal core profile sections at each distance Z along the airfoil, the profile sections at the Z distances being joined smoothly with one another to form the airfoil internal core profile.

In accordance with another embodiment of the present invention, there is provided a turbine comprising a plurality of nozzle segments in a circumferential array about an axis of the turbine, each segment having inner and outer platforms and at least one airfoil extending between the platforms, each airfoil having an internal nominal core profile substantially in accordance with Cartesian coordinate values of X, Y and Z set forth in Table I wherein the Z values are radial distances from the turbine axis to planes extending normal to the radii, and wherein the X and Y values are distances in inches which, when connected by smooth continuing arcs, define internal core profile sections at each distance Z along the airfoil, the profile sections at the Z distances being joined smoothly with one another to form the airfoil internal core profile.

DETAILED DESCRIPTION OF THE INVENTION

Figure 1:
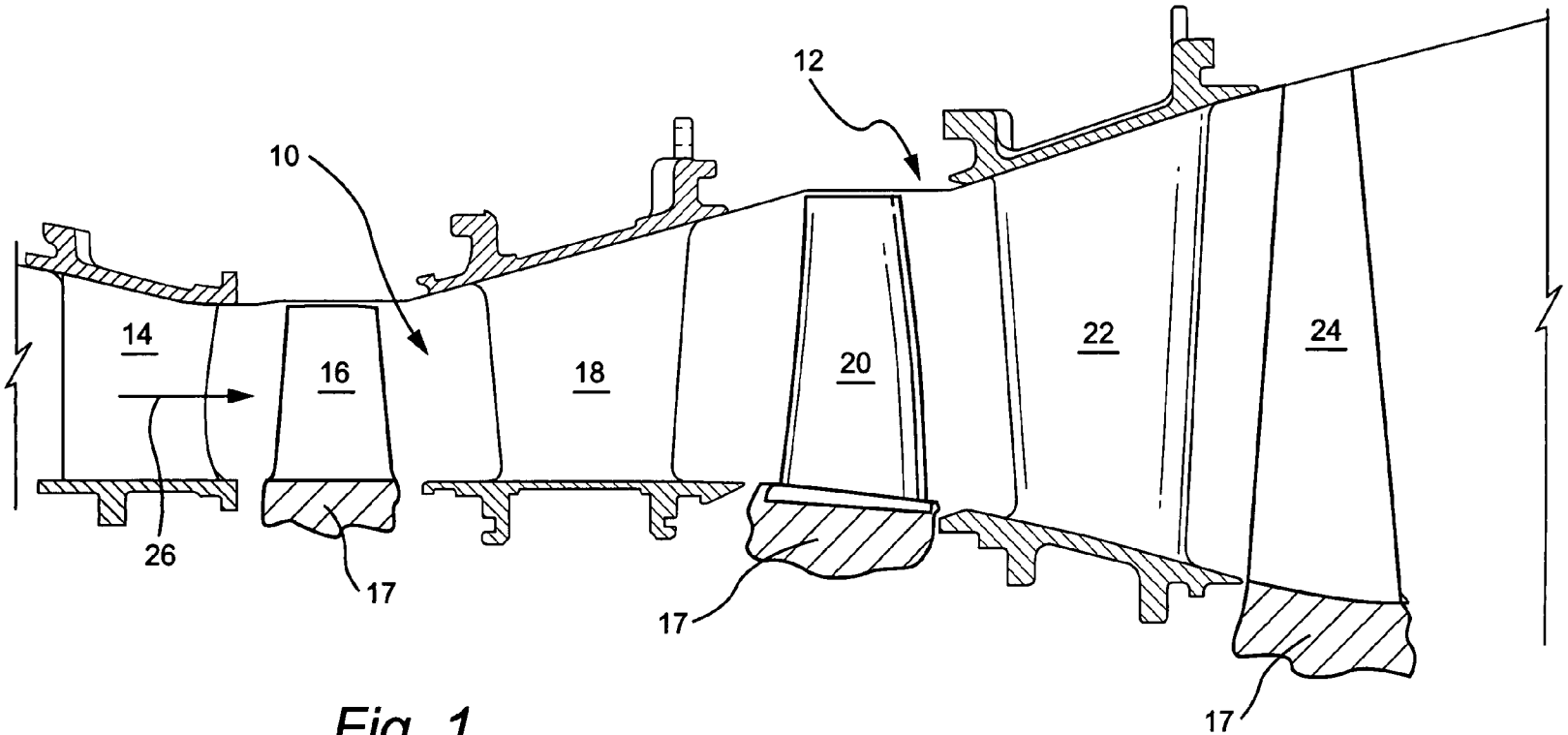
FIG. 1 is a schematic representation of a hot gas path through multiple stages of a gas turbine and illustrates a first stage nozzle airfoil according to a preferred embodiment of the present invention.

Referring now to the drawings, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles 14 are circumferentially spaced one from the other and fixed about the axis of the rotor. First stage buckets 16 are mounted on the turbine rotor 17. A second stage of the turbine 12 is also illustrated, including a plurality of circumferentially spaced nozzles 18 and a plurality of circumferentially spaced buckets 20 mounted on the rotor 17. The third stage is also illustrated including a plurality of circumferentially spaced nozzles 22 and buckets 24 mounted on rotor 17. It will be appreciated that the nozzles and buckets lie in the hot gas path 10 of the turbine, the direction of flow of the hot gas through the hot gas path 10 being indicated by the arrow 26.

Figure 2:
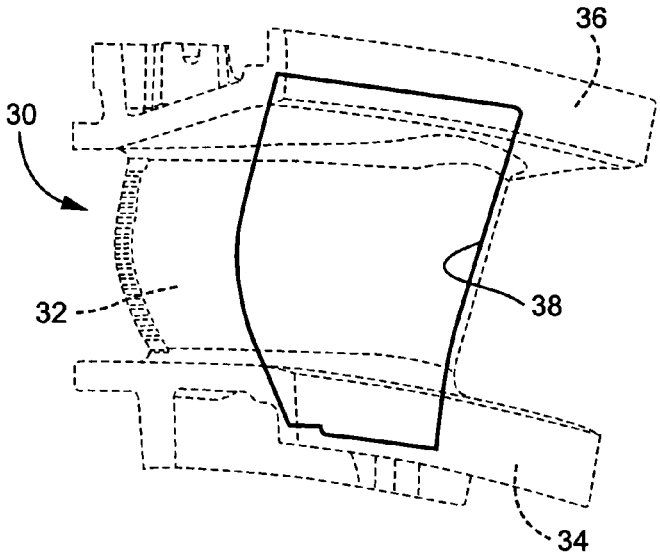
FIG. 2 is a perspective view of a nozzle segment with an internal nozzle airfoil core profile depicted in full lines according to a preferred embodiment of the present invention with the nozzle airfoil shown in conjunction with inner and outer platforms and remaining portions of the nozzle airfoil illustrated by the dashed lines.
Figure 3:
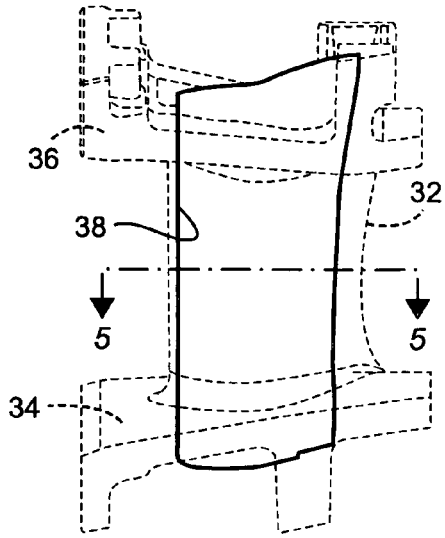
FIG. 3 is a circumferential perspective view of the nozzle airfoil internal core profile of FIG. 2 and associated airfoil and platforms.
Figure 4:
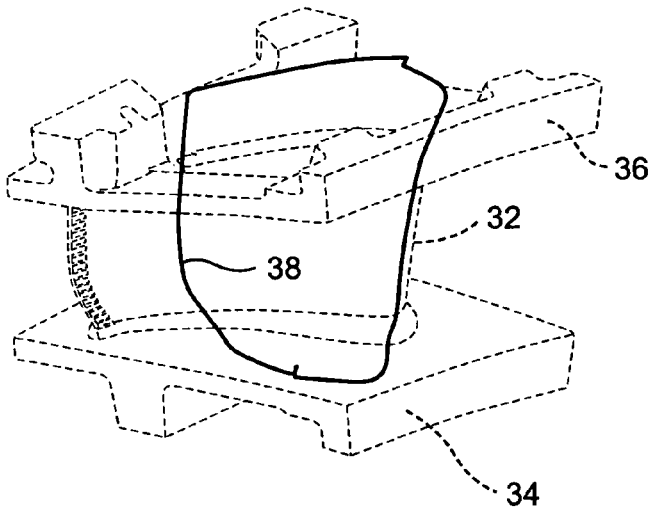
FIG. 4 is a perspective view from above the outer platform of the internal core profile including the associated airfoil and platform.

Referring now to FIG. 2, there is illustrated a nozzle segment generally designated 30 in which one or more airfoils 32 are disposed between inner and outer platforms 34 and 36, respectively. It will be appreciated that a plurality of nozzle segments 30 are disposed in a circumferential array about the turbine axis to form an annular flow path with the airfoils 32 guiding the hot gas to the follow-on buckets of the stage, e.g., the first stage buckets 16. The vanes 32 of the nozzle segments 30 are cooled by flowing air internally within the airfoils 32 and between the inner and outer platforms 34 and 36, respectively.

Figure 5:
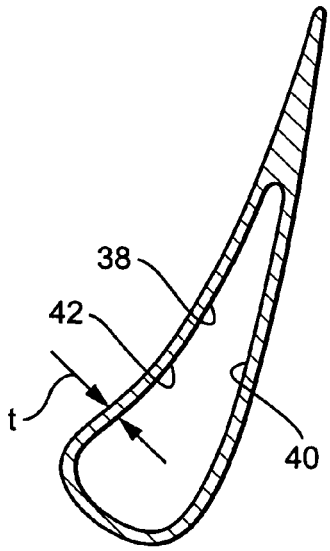
FIG. 5 is a cross-sectional view of the nozzle airfoil taken generally about on line 5-5 in FIG. 3.

The internal core shape of the nozzle airfoil is indicated by the full lines 38 in the drawing figures. In FIG. 5, the internal core shape 38 is in the general form of an airfoil having internal wall surfaces 40 and 42 adjacent suction and pressure external surfaces of the airfoil, respectively, which, with the internal core profile 38, define an airfoil wall thickness t. The internal core profile extends through the inner and outer platforms 34 and 36.

To define the internal core shape of each nozzle airfoil including within the inner and outer platforms, there is provided a unique set of loci of points in space that meet the stage requirements, cooling areas, wall thickness, and can be manufactured. This unique loci of points which define the internal nozzle airfoil core profile 38 comprises a set of 1,200 points relative to the axis of rotation of the turbine. A Cartesian coordinate system of X, Y and Z values given in Table I below define this internal core profile 38 of the nozzle airfoil at various locations along its length. The coordinate values for the X and Y coordinates are set forth in inches in Table I although other units of dimensions may be used when the values are appropriately converted. The Z values set forth in Table I are radial distances from a turbine axis to planes extending normal to the radii. The Cartesian coordinate system has orthogonally related X, Y and Z axes and the X axis lies parallel to the turbine rotor center line, i.e., the rotary axis, and a positive x coordinate value is axial toward the aft, i.e., exhaust end of the turbine. The positive Y coordinate value extends tangentially in the direction of rotation of the rotor, looking aft, and the positive Z coordinate value is radially outwardly toward the outer platform.

By defining X and Y coordinate values at selected locations in a Z direction normal to the X, Y plane, the internal core profile 38 of the nozzle airfoil representatively illustrated by the full lines in the drawing figures, at each Z distance along the length of the nozzle airfoil can be ascertained. By connecting the X and Y values with smooth continuing arcs, each internal core profile section 38 at each distance Z is fixed. The internal core profiles of the various internal locations between the distances Z are determined by smoothly connecting the adjacent profile sections 38 to one another to form the core profile. These values represent the internal core profiles at ambient non-operating or non-hot conditions.

The Table I values are generated and shown to three decimal places for determining the internal core profile of the nozzle airfoil. There are typical manufacturing tolerances as well as coatings which must be accounted for in the actual internal profile of the nozzle airfoil. Accordingly, the values for the profile given in Table I are for a nominal internal nozzle airfoil core profile. It will therefore be appreciated that ±typical manufacturing tolerances, i.e., ±values, including any coating thicknesses, are additive to the X and Y values given in Table I below. Accordingly, a distance of ±0.030 inches in a direction normal to any surface location along the internal core profile defines an internal core profile envelope for this particular nozzle airfoil design and turbine, i.e., a range of variation between measured points on the actual internal core profile at nominal cold or room temperature and the ideal position of those points as given in Table I below at the same temperature. The internal core profile is robust to this range of variation without impairment of mechanical and cooling functions.

The Table I values below provide the X, Y, Z Cartesian values for the internal core of the airfoil including through the inner and outer platforms. The physical configuration of the internal core profile between the inner and outer platforms is provided by Table I between Z value limits of 22.200 and 25.050. These Z value limits commence radially outwardly of the inner platform and radially inwardly of the outer platform, respectively and define the physical shape of the internal core profile between those limits.

The coordinate values given in Table I below provide the preferred nominal internal core profile envelope through the nozzle airfoil including through the inner and outer platforms.

| X | Y | Z | X | Y | Z | X | Y | Z |
|---|---|---|---|---|---|---|---|---|
| −0.582 | −2.413 | 21.250 | −1.406 | −3.884 | 21.250 | −2.385 | −3.350 | 21.250 |
| −0.587 | −2.466 | 21.250 | −1.412 | −2.397 | 21.250 | −2.391 | −4.162 | 21.250 |
| −0.591 | −2.361 | 21.250 | −1.433 | −3.930 | 21.250 | −2.417 | −3.392 | 21.250 |
| −0.604 | −2.516 | 21.250 | −1.458 | −2.423 | 21.250 | −2.435 | −4.134 | 21.250 |
| −0.611 | −2.312 | 21.250 | −1.459 | −3.976 | 21.250 | −2.448 | −3.435 | 21.250 |
| −0.632 | −2.560 | 21.250 | −1.486 | −4.021 | 21.250 | −2.475 | −4.099 | 21.250 |
| −0.641 | −2.269 | 21.250 | −1.504 | −2.449 | 21.250 | −2.479 | −3.478 | 21.250 |
| −0.662 | −2.604 | 21.250 | −1.514 | −4.067 | 21.250 | −2.510 | −4.059 | 21.250 |
| −0.679 | −2.233 | 21.250 | −1.542 | −4.111 | 21.250 | −2.510 | −3.520 | 21.250 |
| −0.692 | −2.648 | 21.250 | −1.549 | −2.476 | 21.250 | −2.539 | −4.015 | 21.250 |
| −0.721 | −2.692 | 21.250 | −1.571 | −4.155 | 21.250 | −2.540 | −3.564 | 21.250 |
| −0.724 | −2.205 | 21.250 | −1.594 | −2.505 | 21.250 | −2.562 | −3.967 | 21.250 |
| −0.750 | −2.736 | 21.250 | −1.602 | −4.199 | 21.250 | −2.567 | −3.610 | 21.250 |
| −0.773 | −2.185 | 21.250 | −1.634 | −4.241 | 21.250 | −2.581 | −3.918 | 21.250 |
| −0.779 | −2.781 | 21.250 | −1.638 | −2.534 | 21.250 | −2.588 | −3.658 | 21.250 |
| −0.807 | −2.826 | 21.250 | −1.669 | −4.280 | 21.250 | −2.588 | −3.658 | 21.250 |
| −0.825 | −2.174 | 21.250 | −1.681 | −2.565 | 21.250 | −2.595 | −3.867 | 21.250 |
| −0.834 | −2.871 | 21.250 | −1.708 | −4.316 | 21.250 | −2.602 | −3.709 | 21.250 |
| −0.862 | −2.916 | 21.250 | −1.723 | −2.597 | 21.250 | −2.604 | −3.815 | 21.250 |
| −0.877 | −2.173 | 21.250 | −1.752 | −4.345 | 21.250 | −2.607 | −3.762 | 21.250 |
| −0.889 | −2.961 | 21.250 | −1.764 | −2.630 | 21.250 | −0.555 | −2.141 | 21.725 |
| −0.916 | −3.007 | 21.250 | −1.801 | −4.364 | 21.250 | −0.564 | −2.197 | 21.725 |
| −0.930 | −2.181 | 21.250 | −1.804 | −2.665 | 21.250 | −0.565 | −2.086 | 21.725 |
| −0.943 | −3.052 | 21.250 | −1.843 | −2.701 | 21.250 | −0.585 | −2.250 | 21.725 |
| −0.970 | −3.098 | 21.250 | −1.853 | −4.372 | 21.250 | −0.594 | −2.037 | 21.725 |
| −0.980 | −2.198 | 21.250 | −1.880 | −2.738 | 21.250 | −0.607 | −2.303 | 21.725 |
| −0.997 | −3.143 | 21.250 | −1.906 | −4.369 | 21.250 | −0.628 | −2.355 | 21.725 |
| −1.023 | −3.189 | 21.250 | −1.917 | −2.776 | 21.250 | −0.637 | −2.000 | 21.725 |
| −1.028 | −2.219 | 21.250 | −1.953 | −2.815 | 21.250 | −0.649 | −2.408 | 21.725 |
| −1.050 | −3.235 | 21.250 | −1.958 | −4.359 | 21.250 | −0.671 | −2.461 | 21.725 |
| −1.076 | −3.281 | 21.250 | −1.989 | −2.854 | 21.250 | −0.688 | −1.975 | 21.725 |
| −1.077 | −2.239 | 21.250 | −2.008 | −4.343 | 21.250 | −0.692 | −2.513 | 21.725 |
| −1.101 | −3.327 | 21.250 | −2.024 | −2.894 | 21.250 | −0.714 | −2.566 | 21.725 |
| −1.126 | −2.260 | 21.250 | −2.058 | −4.324 | 21.250 | −0.735 | −2.619 | 21.725 |
| −1.127 | −3.374 | 21.250 | −2.059 | −2.933 | 21.250 | −0.744 | −1.966 | 21.725 |
| −1.152 | −3.421 | 21.250 | −2.093 | −2.974 | 21.250 | −0.757 | −2.671 | 21.725 |
| −1.174 | −2.281 | 21.250 | −2.106 | −4.302 | 21.250 | −0.778 | −2.724 | 21.725 |
| −1.177 | −3.467 | 21.250 | −2.127 | −3.015 | 21.250 | −0.800 | −2.777 | 21.725 |
| −1.202 | −3.514 | 21.250 | −2.154 | −4.279 | 21.250 | −0.800 | −1.972 | 21.725 |
| −1.222 | −2.303 | 21.250 | −2.160 | −3.056 | 21.250 | −0.821 | −2.829 | 21.725 |
| −1.227 | −3.560 | 21.250 | −2.193 | −3.097 | 21.250 | −0.842 | −2.882 | 21.725 |
| −1.252 | −3.607 | 21.250 | −2.201 | −4.255 | 21.250 | −0.853 | −1.993 | 21.725 |
| −1.270 | −2.326 | 21.250 | −2.226 | −3.139 | 21.250 | −0.864 | −2.935 | 21.725 |
| −1.278 | −3.653 | 21.250 | −2.248 | −4.231 | 21.250 | −0.885 | −2.987 | 21.725 |
| −1.303 | −3.699 | 21.250 | −2.258 | −3.180 | 21.250 | −0.897 | −2.028 | 21.725 |
| −1.318 | −2.349 | 21.250 | −2.290 | −3.223 | 21.250 | −0.907 | −3.040 | 21.725 |
| −1.329 | −3.746 | 21.250 | −2.295 | −4.208 | 21.250 | −0.928 | −3.093 | 21.725 |
| −0.983 | −2.103 | 21.725 | −1.899 | −2.955 | 21.725 | −0.678 | −2.351 | 22.200 |
| −0.993 | −3.251 | 21.725 | −1.919 | −4.432 | 21.725 | −0.682 | −1.761 | 22.200 |
| −1.014 | −3.303 | 21.725 | −1.938 | −2.996 | 21.725 | −0.694 | −2.411 | 22.200 |
| −1.026 | −2.141 | 21.725 | −1.976 | −4.429 | 21.725 | −0.710 | −2.470 | 22.200 |
| −1.036 | −3.356 | 21.725 | −1.977 | −3.038 | 21.725 | −0.726 | −2.529 | 22.200 |
| −1.058 | −3.408 | 21.725 | −2.015 | −3.080 | 21.725 | −0.742 | −2.588 | 22.200 |
| −1.069 | −2.178 | 21.725 | −2.032 | −4.421 | 21.725 | −0.742 | −1.768 | 22.200 |
| −1.080 | −3.461 | 21.725 | −2.054 | −3.122 | 21.725 | −0.758 | −2.647 | 22.200 |
| −1.102 | −3.513 | 21.725 | −2.088 | −4.410 | 21.725 | −0.775 | −2.706 | 22.200 |
| −1.112 | −2.215 | 21.725 | −2.092 | −3.164 | 21.725 | −0.791 | −2.765 | 22.200 |
| −1.125 | −3.565 | 21.725 | −2.130 | −3.206 | 21.725 | −0.794 | −1.799 | 22.200 |
| −1.148 | −3.618 | 21.725 | −2.143 | −4.395 | 21.725 | −0.808 | −2.824 | 22.200 |
| −1.155 | −2.253 | 21.725 | −2.168 | −3.248 | 21.725 | −0.825 | −2.883 | 22.200 |
| −1.171 | −3.670 | 21.725 | −2.197 | −4.378 | 21.725 | −0.831 | −1.848 | 22.200 |
| −1.194 | −3.721 | 21.725 | −2.206 | −3.291 | 21.725 | −0.842 | −2.942 | 22.200 |
| −1.198 | −2.290 | 21.725 | −2.243 | −3.334 | 21.725 | −0.859 | −3.000 | 22.200 |
| −1.218 | −3.773 | 21.725 | −2.250 | −4.358 | 21.725 | −0.865 | −1.899 | 22.200 |
| −1.240 | −2.327 | 21.725 | −2.280 | −3.377 | 21.725 | −0.877 | −3.059 | 22.200 |
| −1.243 | −3.824 | 21.725 | −2.303 | −4.337 | 21.725 | −0.895 | −3.118 | 22.200 |
| −1.268 | −3.875 | 21.725 | −2.317 | −3.420 | 21.725 | −0.900 | −1.949 | 22.200 |
| −1.283 | −2.365 | 21.725 | −2.354 | −3.464 | 21.725 | −0.913 | −3.176 | 22.200 |
| −1.294 | −3.926 | 21.725 | −2.354 | −4.313 | 21.725 | −0.931 | −3.235 | 22.200 |
| −1.321 | −3.976 | 21.725 | −2.390 | −3.507 | 21.725 | −0.936 | −1.999 | 22.200 |
| −1.326 | −2.403 | 21.725 | −2.404 | −4.285 | 21.725 | −0.950 | −3.293 | 22.200 |
| −1.350 | −4.025 | 21.725 | −2.426 | −3.551 | 21.725 | −0.969 | −3.351 | 22.200 |
| −1.368 | −2.440 | 21.725 | −2.450 | −4.252 | 21.725 | −0.971 | −2.049 | 22.200 |
| −1.379 | −4.074 | 21.725 | −2.450 | −4.252 | 21.725 | −0.989 | −3.409 | 22.200 |
| −1.410 | −4.121 | 21.725 | −2.463 | −3.595 | 21.725 | −1.007 | −2.099 | 22.200 |
| −1.411 | −2.478 | 21.725 | −2.491 | −4.213 | 21.725 | −1.009 | −3.467 | 22.200 |
| −1.443 | −4.168 | 21.725 | −2.498 | −3.639 | 21.725 | −1.030 | −3.524 | 22.200 |

-continued

| X | Y | Z | X | Y | Z | X | Y | Z |
|---|---|---|---|---|---|---|---|---|
| −1.453 | −2.517 | 21.725 | −2.525 | −4.167 | 21.725 | −1.043 | −2.148 | 22.200 |
| −1.478 | −4.212 | 21.725 | −2.532 | −3.685 | 21.725 | −1.051 | −3.582 | 22.200 |
| −1.494 | −2.555 | 21.725 | −2.552 | −4.117 | 21.725 | −1.073 | −3.639 | 22.200 |
| −1.516 | −4.255 | 21.725 | −2.562 | −3.733 | 21.725 | −1.080 | −2.197 | 22.200 |
| −1.536 | −2.594 | 21.725 | −2.574 | −4.064 | 21.725 | −1.096 | −3.696 | 22.200 |
| −1.556 | −4.295 | 21.725 | −2.585 | −3.785 | 21.725 | −1.117 | −2.246 | 22.200 |
| −1.577 | −2.633 | 21.725 | −2.589 | −4.010 | 21.725 | −1.119 | −3.753 | 22.200 |
| −1.600 | −4.331 | 21.725 | −2.599 | −3.840 | 21.725 | −1.143 | −3.809 | 22.200 |
| −1.618 | −2.672 | 21.725 | −2.599 | −3.954 | 21.725 | −1.155 | −2.294 | 22.200 |
| −1.647 | −4.363 | 21.725 | −2.603 | −3.897 | 21.725 | −1.168 | −3.865 | 22.200 |
| −1.659 | −2.712 | 21.725 | −0.559 | −1.877 | 22.200 | −1.192 | −2.343 | 22.200 |
| −1.697 | −4.390 | 21.725 | −0.568 | −1.937 | 22.200 | −1.195 | −3.920 | 22.200 |
| −1.700 | −2.752 | 21.725 | −0.579 | −1.820 | 22.200 | −1.222 | −3.975 | 22.200 |
| −1.740 | −2.792 | 21.725 | −0.584 | −1.996 | 22.200 | −1.230 | −2.391 | 22.200 |
| −1.750 | −4.410 | 21.725 | −0.599 | −2.055 | 22.200 | −1.251 | −4.029 | 22.200 |
| −1.780 | −2.832 | 21.725 | −0.615 | −2.115 | 22.200 | −1.269 | −2.438 | 22.200 |
| −1.806 | −4.424 | 21.725 | −0.624 | −1.779 | 22.200 | −1.281 | −4.082 | 22.200 |
| −1.346 | −4.186 | 22.200 | −2.509 | −4.296 | 22.200 | −1.017 | −2.034 | 22.675 |
| −1.382 | −4.235 | 22.200 | −2.520 | −3.783 | 22.200 | −1.023 | −3.527 | 22.675 |
| −1.386 | −2.580 | 22.200 | −2.542 | −4.244 | 22.200 | −1.043 | −3.590 | 22.675 |
| −1.420 | −4.283 | 22.200 | −2.554 | −3.833 | 22.200 | −1.049 | −2.092 | 22.675 |
| −1.425 | −2.627 | 22.200 | −2.567 | −4.189 | 22.200 | −1.064 | −3.652 | 22.675 |
| −1.461 | −4.329 | 22.200 | −2.581 | −3.888 | 22.200 | −1.082 | −2.149 | 22.675 |
| −1.465 | −2.673 | 22.200 | −2.585 | −4.130 | 22.200 | −1.086 | −3.714 | 22.675 |
| −1.505 | −4.371 | 22.200 | −2.596 | −3.948 | 22.200 | −1.108 | −3.776 | 22.675 |
| −1.506 | −2.719 | 22.200 | −2.596 | −4.070 | 22.200 | −1.116 | −2.205 | 22.675 |
| −1.546 | −2.765 | 22.200 | −2.601 | −4.009 | 22.200 | −1.132 | −3.838 | 22.675 |
| −1.553 | −4.410 | 22.200 | −0.578 | −1.672 | 22.675 | −1.150 | −2.262 | 22.675 |
| −1.587 | −2.811 | 22.200 | −0.590 | −1.609 | 22.675 | −1.156 | −3.899 | 22.675 |
| −1.603 | −4.444 | 22.200 | −0.591 | −1.737 | 22.675 | −1.181 | −3.960 | 22.675 |
| −1.629 | −2.856 | 22.200 | −0.604 | −1.801 | 22.675 | −1.184 | −2.318 | 22.675 |
| −1.658 | −4.473 | 22.200 | −0.617 | −1.866 | 22.675 | −1.208 | −4.020 | 22.675 |
| −1.670 | −2.901 | 22.200 | −0.630 | −1.930 | 22.675 | −1.219 | −2.374 | 22.675 |
| −1.712 | −2.945 | 22.200 | −0.638 | −1.564 | 22.675 | −1.236 | −4.080 | 22.675 |
| −1.715 | −4.496 | 22.200 | −0.643 | −1.995 | 22.675 | −1.254 | −2.429 | 22.675 |
| −1.754 | −2.990 | 22.200 | −0.656 | −2.059 | 22.675 | −1.265 | −4.139 | 22.675 |
| −1.774 | −4.512 | 22.200 | −0.670 | −2.124 | 22.675 | −1.290 | −2.485 | 22.675 |
| −1.796 | −3.034 | 22.200 | −0.683 | −2.188 | 22.675 | −1.296 | −4.197 | 22.675 |
| −1.834 | −4.521 | 22.200 | −0.697 | −2.252 | 22.675 | −1.326 | −2.540 | 22.675 |
| −1.839 | −3.078 | 22.200 | −0.701 | −1.552 | 22.675 | −1.328 | −4.254 | 22.675 |
| −1.882 | −3.122 | 22.200 | −0.711 | −2.317 | 22.675 | −1.363 | −2.594 | 22.675 |
| −1.895 | −4.525 | 22.200 | −0.725 | −2.381 | 22.675 | −1.363 | −4.310 | 22.675 |
| −1.925 | −3.166 | 22.200 | −0.740 | −2.445 | 22.675 | −1.400 | −2.648 | 22.675 |
| −1.956 | −4.524 | 22.200 | −0.754 | −2.510 | 22.675 | −1.400 | −4.364 | 22.675 |
| −1.968 | −3.210 | 22.200 | −0.762 | −1.575 | 22.675 | −1.438 | −2.702 | 22.675 |
| −2.011 | −3.253 | 22.200 | −0.769 | −2.574 | 22.675 | −1.440 | −4.417 | 22.675 |
| −2.017 | −4.519 | 22.200 | −0.784 | −2.638 | 22.675 | −1.476 | −2.756 | 22.675 |
| −2.054 | −3.297 | 22.200 | −0.799 | −2.702 | 22.675 | −1.483 | −4.466 | 22.675 |
| −2.078 | −4.509 | 22.200 | −0.801 | −1.627 | 22.675 | −1.515 | −2.809 | 22.675 |
| −2.097 | −3.340 | 22.200 | −0.814 | −2.766 | 22.675 | −1.530 | −4.513 | 22.675 |
| −2.138 | −4.496 | 22.200 | −0.830 | −2.830 | 22.675 | −1.555 | −2.861 | 22.675 |
| −2.140 | −3.384 | 22.200 | −0.831 | −1.686 | 22.675 | −1.581 | −4.554 | 22.675 |
| −2.183 | −3.427 | 22.200 | −0.845 | −2.894 | 22.675 | −1.595 | −2.913 | 22.675 |
| −2.197 | −4.479 | 22.200 | −0.861 | −1.745 | 22.675 | −1.636 | −4.590 | 22.675 |
| −2.226 | −3.471 | 22.200 | −0.862 | −2.958 | 22.675 | −1.636 | −2.965 | 22.675 |
| −2.254 | −4.459 | 22.200 | −0.878 | −3.021 | 22.675 | −1.678 | −3.016 | 22.675 |
| −2.269 | −3.515 | 22.200 | −0.891 | −1.803 | 22.675 | −1.696 | −4.618 | 22.675 |
| −2.311 | −4.436 | 22.200 | −0.895 | −3.085 | 22.675 | −1.721 | −3.066 | 22.675 |
| −2.311 | −3.559 | 22.200 | −0.912 | −3.149 | 22.675 | −1.759 | −4.637 | 22.675 |
| −2.354 | −3.603 | 22.200 | −0.922 | −1.861 | 22.675 | −1.764 | −3.116 | 22.675 |
| −2.366 | −4.409 | 22.200 | −0.929 | −3.212 | 22.675 | −1.807 | −3.165 | 22.675 |
| −2.396 | −3.647 | 22.200 | −0.947 | −3.275 | 22.675 | −1.824 | −4.647 | 22.675 |
| −2.419 | −4.378 | 22.200 | −0.953 | −1.919 | 22.675 | −1.852 | −3.213 | 22.675 |
| −2.438 | −3.691 | 22.200 | −0.965 | −3.339 | 22.675 | −1.889 | −4.648 | 22.675 |
| −1.990 | −3.355 | 22.675 | −0.789 | −1.523 | 23.150 | −1.454 | −2.815 | 23.150 |
| −2.019 | −4.629 | 22.675 | −0.795 | −2.684 | 23.150 | −1.472 | −4.561 | 23.150 |
| −2.037 | −3.400 | 22.675 | −0.810 | −2.752 | 23.150 | −1.493 | −2.872 | 23.150 |
| −2.083 | −4.612 | 22.675 | −0.816 | −1.587 | 23.150 | −1.516 | −4.615 | 23.150 |
| −2.085 | −3.446 | 22.675 | −0.825 | −2.819 | 23.150 | −1.533 | −2.929 | 23.150 |
| −2.133 | −3.490 | 22.675 | −0.841 | −2.887 | 23.150 | −1.565 | −4.664 | 23.150 |
| −2.145 | −4.591 | 22.675 | −0.844 | −1.651 | 23.150 | −1.573 | −2.985 | 23.150 |
| −2.182 | −3.535 | 22.675 | −0.857 | −2.954 | 23.150 | −1.615 | −3.041 | 23.150 |
| −2.206 | −4.566 | 22.675 | −0.871 | −1.714 | 23.150 | −1.618 | −4.708 | 23.150 |
| −2.231 | −3.579 | 22.675 | −0.873 | −3.021 | 23.150 | −1.657 | −3.095 | 23.150 |
| −2.266 | −4.538 | 22.675 | −0.890 | −3.089 | 23.150 | −1.676 | −4.746 | 23.150 |
| −2.280 | −3.622 | 22.675 | −0.899 | −1.778 | 23.150 | −1.701 | −3.149 | 23.150 |
| −2.324 | −4.508 | 22.675 | −0.907 | −3.156 | 23.150 | −1.740 | −4.773 | 23.150 |

-continued

| X | Y | Z | X | Y | Z | X | Y | Z |
|---|---|---|---|---|---|---|---|---|
| −2.329 | −3.666 | 22.675 | −0.924 | −3.223 | 23.150 | −1.745 | −3.203 | 23.150 |
| −2.378 | −3.710 | 22.675 | −0.928 | −1.841 | 23.150 | −1.790 | −3.255 | 23.150 |
| −2.381 | −4.475 | 22.675 | −0.942 | −3.290 | 23.150 | −1.807 | −4.788 | 23.150 |
| −2.426 | −3.755 | 22.675 | −0.957 | −1.904 | 23.150 | −1.837 | −3.306 | 23.150 |
| −2.435 | −4.438 | 22.675 | −0.961 | −3.357 | 23.150 | −1.876 | −4.791 | 23.150 |
| −2.474 | −3.800 | 22.675 | −0.979 | −3.423 | 23.150 | −1.884 | −3.357 | 23.150 |
| −2.485 | −4.394 | 22.675 | −0.986 | −1.967 | 23.150 | −1.932 | −3.407 | 23.150 |
| −2.518 | −3.849 | 22.675 | −0.999 | −3.490 | 23.150 | −1.945 | −4.783 | 23.150 |
| −2.526 | −4.343 | 22.675 | −1.016 | −2.029 | 23.150 | −1.981 | −3.456 | 23.150 |
| −2.555 | −3.903 | 22.675 | −1.019 | −3.556 | 23.150 | −2.012 | −4.766 | 23.150 |
| −2.555 | −3.903 | 22.675 | −1.039 | −3.622 | 23.150 | −2.031 | −3.503 | 23.150 |
| −2.557 | −4.285 | 22.675 | −1.046 | −2.092 | 23.150 | −2.077 | −4.743 | 23.150 |
| −2.579 | −4.223 | 22.675 | −1.060 | −3.688 | 23.150 | −2.082 | −3.551 | 23.150 |
| −2.582 | −3.963 | 22.675 | −1.076 | −2.154 | 23.150 | −2.134 | −3.597 | 23.150 |
| −2.592 | −4.159 | 22.675 | −1.082 | −3.754 | 23.150 | −2.141 | −4.715 | 23.150 |
| −2.595 | −4.028 | 22.675 | −1.105 | −3.819 | 23.150 | −2.186 | −3.643 | 23.150 |
| −2.598 | −4.093 | 22.675 | −1.108 | −2.216 | 23.150 | −2.202 | −4.683 | 23.150 |
| −0.583 | −1.527 | 23.150 | −1.128 | −3.884 | 23.150 | −2.238 | −3.687 | 23.150 |
| −0.587 | −1.596 | 23.150 | −1.139 | −2.277 | 23.150 | −2.262 | −4.648 | 23.150 |
| −0.598 | −1.664 | 23.150 | −1.153 | −3.949 | 23.150 | −2.291 | −3.732 | 23.150 |
| −0.610 | −1.732 | 23.150 | −1.172 | −2.338 | 23.150 | −2.321 | −4.611 | 23.150 |
| −0.621 | −1.470 | 23.150 | −1.178 | −4.014 | 23.150 | −2.345 | −3.776 | 23.150 |
| −0.622 | −1.800 | 23.150 | −1.204 | −4.078 | 23.150 | −2.378 | −4.573 | 23.150 |
| −0.634 | −1.869 | 23.150 | −1.205 | −2.399 | 23.150 | −2.398 | −3.821 | 23.150 |
| −0.646 | −1.937 | 23.150 | −1.232 | −4.141 | 23.150 | −2.434 | −4.532 | 23.150 |
| −0.659 | −2.005 | 23.150 | −1.238 | −2.460 | 23.150 | −2.451 | −3.866 | 23.150 |
| −0.672 | −2.073 | 23.150 | −1.261 | −4.204 | 23.150 | −2.485 | −4.485 | 23.150 |
| −0.684 | −2.141 | 23.150 | −1.272 | −2.520 | 23.150 | −2.500 | −3.914 | 23.150 |
| −0.685 | −1.448 | 23.150 | −1.291 | −4.267 | 23.150 | −2.529 | −4.431 | 23.150 |
| −0.697 | −2.209 | 23.150 | −1.307 | −2.580 | 23.150 | −2.543 | −3.969 | 23.150 |
| −0.711 | −2.277 | 23.150 | −1.323 | −4.328 | 23.150 | −2.543 | −3.969 | 23.150 |
| −0.724 | −2.345 | 23.150 | −1.343 | −2.639 | 23.150 | −2.560 | −4.370 | 23.150 |
| −0.738 | −2.413 | 23.150 | −1.356 | −4.389 | 23.150 | −2.573 | −4.031 | 23.150 |
| −0.750 | −1.468 | 23.150 | −1.379 | −2.698 | 23.150 | −2.581 | −4.304 | 23.150 |
| −0.566 | −1.586 | 23.625 | −1.110 | −3.950 | 23.625 | −2.226 | −3.794 | 23.625 |
| −0.567 | −1.515 | 23.625 | −1.115 | −2.326 | 23.625 | −2.246 | −4.780 | 23.625 |
| −0.578 | −1.656 | 23.625 | −1.135 | −4.017 | 23.625 | −2.282 | −3.837 | 23.625 |
| −0.590 | −1.727 | 23.625 | −1.147 | −2.390 | 23.625 | −2.305 | −4.739 | 23.625 |
| −0.602 | −1.797 | 23.625 | −1.160 | −4.084 | 23.625 | −2.339 | −3.881 | 23.625 |
| −0.610 | −1.460 | 23.625 | −1.179 | −2.454 | 23.625 | −2.362 | −4.696 | 23.625 |
| −0.614 | −1.868 | 23.625 | −1.186 | −4.151 | 23.625 | −2.396 | −3.924 | 23.625 |
| −0.626 | −1.938 | 23.625 | −1.212 | −2.517 | 23.625 | −2.418 | −4.652 | 23.625 |
| −0.639 | −2.008 | 23.625 | −1.213 | −4.217 | 23.625 | −2.452 | −3.968 | 23.625 |
| −0.652 | −2.079 | 23.625 | −1.242 | −4.282 | 23.625 | −2.471 | −4.604 | 23.625 |
| −0.665 | −2.149 | 23.625 | −1.246 | −2.580 | 23.625 | −2.504 | −4.017 | 23.625 |
| −0.678 | −2.219 | 23.625 | −1.272 | −4.347 | 23.625 | −2.519 | −4.551 | 23.625 |
| −0.679 | −1.445 | 23.625 | −1.280 | −2.643 | 23.625 | −2.519 | −4.551 | 23.625 |
| −0.691 | −2.289 | 23.625 | −1.304 | −4.411 | 23.625 | −2.546 | −4.074 | 23.625 |
| −0.705 | −2.359 | 23.625 | −1.315 | −2.705 | 23.625 | −2.555 | −4.489 | 23.625 |
| −0.718 | −2.430 | 23.625 | −1.337 | −4.474 | 23.625 | −2.575 | −4.140 | 23.625 |
| −0.732 | −2.500 | 23.625 | −1.351 | −2.767 | 23.625 | −2.579 | −4.422 | 23.625 |
| −0.741 | −1.477 | 23.625 | −1.372 | −4.536 | 23.625 | −2.590 | −4.209 | 23.625 |
| −0.747 | −2.570 | 23.625 | −1.388 | −2.828 | 23.625 | −2.591 | −4.352 | 23.625 |
| −0.761 | −2.640 | 23.625 | −1.410 | −4.597 | 23.625 | −2.595 | −4.281 | 23.625 |
| −0.773 | −1.540 | 23.625 | −1.426 | −2.889 | 23.625 | −0.522 | −1.602 | 24.100 |
| −0.776 | −2.709 | 23.625 | −1.451 | −4.656 | 23.625 | −0.531 | −1.674 | 24.100 |
| −0.791 | −2.779 | 23.625 | −1.464 | −2.949 | 23.625 | −0.544 | −1.746 | 24.100 |
| −0.799 | −1.607 | 23.625 | −1.494 | −4.712 | 23.625 | −0.548 | −1.535 | 24.100 |
| −0.807 | −2.849 | 23.625 | −1.503 | −3.009 | 23.625 | −0.556 | −1.818 | 24.100 |
| −0.822 | −2.919 | 23.625 | −1.541 | −4.766 | 23.625 | −0.569 | −1.890 | 24.100 |
| −0.826 | −1.673 | 23.625 | −1.543 | −3.068 | 23.625 | −0.581 | −1.962 | 24.100 |
| −0.838 | −2.988 | 23.625 | −1.585 | −3.126 | 23.625 | −0.594 | −2.034 | 24.100 |
| −0.853 | −1.739 | 23.625 | −1.593 | −4.815 | 23.625 | −0.608 | −2.106 | 24.100 |
| −0.855 | −3.058 | 23.625 | −1.627 | −3.184 | 23.625 | −0.609 | −1.497 | 24.100 |
| −0.872 | −3.127 | 23.625 | −1.650 | −4.858 | 23.625 | −0.621 | −2.178 | 24.100 |
| −0.880 | −1.805 | 23.625 | −1.670 | −3.241 | 23.625 | −0.634 | −2.250 | 24.100 |
| −0.889 | −3.197 | 23.625 | −1.712 | −4.893 | 23.625 | −0.648 | −2.322 | 24.100 |
| −0.906 | −3.266 | 23.625 | −1.715 | −3.296 | 23.625 | −0.662 | −2.394 | 24.100 |
| −0.908 | −1.871 | 23.625 | −1.761 | −3.351 | 23.625 | −0.676 | −2.465 | 24.100 |
| −0.924 | −3.335 | 23.625 | −1.780 | −4.916 | 23.625 | −0.681 | −1.504 | 24.100 |
| −0.936 | −1.937 | 23.625 | −1.808 | −3.405 | 23.625 | −0.691 | −2.537 | 24.100 |
| −0.943 | −3.404 | 23.625 | −1.850 | −4.926 | 23.625 | −0.706 | −2.609 | 24.100 |
| −0.962 | −3.473 | 23.625 | −1.856 | −3.458 | 23.625 | −0.721 | −2.680 | 24.100 |
| −0.964 | −2.002 | 23.625 | −1.905 | −3.509 | 23.625 | −0.733 | −1.554 | 24.100 |
| −0.981 | −3.542 | 23.625 | −1.922 | −4.922 | 23.625 | −0.736 | −2.752 | 24.100 |
| −0.993 | −2.068 | 23.625 | −1.956 | −3.560 | 23.625 | −0.752 | −2.823 | 24.100 |
| −1.001 | −3.610 | 23.625 | −1.991 | −4.907 | 23.625 | −0.760 | −1.622 | 24.100 |

-continued

| X | Y | Z | X | Y | Z | X | Y | Z |
|---|---|---|---|---|---|---|---|---|
| −1.021 | −3.679 | 23.625 | −2.008 | −3.609 | 23.625 | −0.767 | −2.895 | 24.100 |
| −1.023 | −2.133 | 23.625 | −2.059 | −4.883 | 23.625 | −0.784 | −2.966 | 24.100 |
| −1.043 | −3.747 | 23.625 | −2.061 | −3.657 | 23.625 | −0.786 | −1.690 | 24.100 |
| −1.053 | −2.198 | 23.625 | −2.115 | −3.704 | 23.625 | −0.800 | −3.037 | 24.100 |
| −0.840 | −1.826 | 24.100 | −1.620 | −4.963 | 24.100 | −0.595 | −2.289 | 24.575 |
| −0.852 | −3.250 | 24.100 | −1.638 | −3.384 | 24.100 | −0.610 | −2.362 | 24.575 |
| −0.868 | −1.894 | 24.100 | −1.680 | −5.005 | 24.100 | −0.625 | −2.434 | 24.575 |
| −0.870 | −3.321 | 24.100 | −1.683 | −3.442 | 24.100 | −0.634 | −1.585 | 24.575 |
| −0.889 | −3.392 | 24.100 | −1.729 | −3.499 | 24.100 | −0.640 | −2.507 | 24.575 |
| −0.896 | −1.961 | 24.100 | −1.746 | −5.037 | 24.100 | −0.656 | −2.579 | 24.575 |
| −0.908 | −3.463 | 24.100 | −1.778 | −3.554 | 24.100 | −0.672 | −2.652 | 24.575 |
| −0.924 | −2.029 | 24.100 | −1.816 | −5.057 | 24.100 | −0.688 | −2.724 | 24.575 |
| −0.927 | −3.533 | 24.100 | −1.828 | −3.607 | 24.100 | −0.695 | −1.626 | 24.575 |
| −0.947 | −3.603 | 24.100 | −1.880 | −3.658 | 24.100 | −0.704 | −2.797 | 24.575 |
| −0.952 | −2.096 | 24.100 | −1.889 | −5.062 | 24.100 | −0.721 | −2.869 | 24.575 |
| −0.968 | −3.674 | 24.100 | −1.934 | −3.708 | 24.100 | −0.727 | −1.693 | 24.575 |
| −0.981 | −2.164 | 24.100 | −1.961 | −5.054 | 24.100 | −0.738 | −2.941 | 24.575 |
| −0.989 | −3.744 | 24.100 | −1.989 | −3.755 | 24.100 | −0.754 | −1.762 | 24.575 |
| −1.010 | −2.231 | 24.100 | −2.032 | −5.034 | 24.100 | −0.755 | −3.014 | 24.575 |
| −1.011 | −3.813 | 24.100 | −2.047 | −3.801 | 24.100 | −0.773 | −3.086 | 24.575 |
| −1.033 | −3.883 | 24.100 | −2.099 | −5.005 | 24.100 | −0.782 | −1.830 | 24.575 |
| −1.039 | −2.298 | 24.100 | −2.105 | −3.845 | 24.100 | −0.790 | −3.158 | 24.575 |
| −1.057 | −3.952 | 24.100 | −2.164 | −4.971 | 24.100 | −0.809 | −3.230 | 24.575 |
| −1.069 | −2.364 | 24.100 | −2.165 | −3.887 | 24.100 | −0.810 | −1.899 | 24.575 |
| −1.081 | −4.021 | 24.100 | −2.225 | −4.931 | 24.100 | −0.827 | −3.302 | 24.575 |
| −1.099 | −2.431 | 24.100 | −2.226 | −3.928 | 24.100 | −0.838 | −1.968 | 24.575 |
| −1.106 | −4.090 | 24.100 | −2.285 | −4.889 | 24.100 | −0.846 | −3.373 | 24.575 |
| −1.130 | −2.497 | 24.100 | −2.287 | −3.968 | 24.100 | −0.865 | −3.445 | 24.575 |
| −1.132 | −4.159 | 24.100 | −2.342 | −4.843 | 24.100 | −0.866 | −2.036 | 24.575 |
| −1.159 | −4.227 | 24.100 | −2.348 | −4.008 | 24.100 | −0.885 | −3.517 | 24.575 |
| −1.162 | −2.563 | 24.100 | −2.397 | −4.796 | 24.100 | −0.895 | −2.105 | 24.575 |
| −1.187 | −4.294 | 24.100 | −2.409 | −4.049 | 24.100 | −0.905 | −3.588 | 24.575 |
| −1.193 | −2.629 | 24.100 | −2.451 | −4.746 | 24.100 | −0.924 | −2.173 | 24.575 |
| −1.216 | −4.361 | 24.100 | −2.466 | −4.093 | 24.100 | −0.926 | −3.659 | 24.575 |
| −1.226 | −2.695 | 24.100 | −2.501 | −4.693 | 24.100 | −0.947 | −3.731 | 24.575 |
| −1.246 | −4.428 | 24.100 | −2.517 | −4.146 | 24.100 | −0.953 | −2.242 | 24.575 |
| −1.259 | −2.760 | 24.100 | −2.517 | −4.146 | 24.100 | −0.968 | −3.802 | 24.575 |
| −1.279 | −4.493 | 24.100 | −2.543 | −4.633 | 24.100 | −0.983 | −2.310 | 24.575 |
| −1.293 | −2.825 | 24.100 | −2.556 | −4.208 | 24.100 | −0.990 | −3.872 | 24.575 |
| −1.312 | −4.558 | 24.100 | −2.572 | −4.566 | 24.100 | −1.012 | −2.378 | 24.575 |
| −1.327 | −2.890 | 24.100 | −2.580 | −4.277 | 24.100 | −1.013 | −3.943 | 24.575 |
| −1.348 | −4.622 | 24.100 | −2.589 | −4.495 | 24.100 | −1.037 | −4.014 | 24.575 |
| −1.362 | −2.954 | 24.100 | −2.592 | −4.349 | 24.100 | −1.043 | −2.445 | 24.575 |
| −1.386 | −4.685 | 24.100 | −2.595 | −4.422 | 24.100 | −1.061 | −4.084 | 24.575 |
| −1.398 | −3.017 | 24.100 | −0.485 | −1.705 | 24.575 | −1.073 | −2.513 | 24.575 |
| −1.426 | −4.746 | 24.100 | −0.497 | −1.779 | 24.575 | −1.085 | −4.154 | 24.575 |
| −1.435 | −3.080 | 24.100 | −0.505 | −1.635 | 24.575 | −1.104 | −2.580 | 24.575 |
| −1.469 | −4.805 | 24.100 | −0.511 | −1.852 | 24.575 | −1.111 | −4.223 | 24.575 |
| −1.473 | −3.143 | 24.100 | −0.524 | −1.925 | 24.575 | −1.136 | −2.648 | 24.575 |
| −1.513 | −3.205 | 24.100 | −0.538 | −1.997 | 24.575 | −1.138 | −4.293 | 24.575 |
| −1.515 | −4.861 | 24.100 | −0.552 | −2.070 | 24.575 | −1.165 | −4.362 | 24.575 |
| −1.224 | −4.498 | 24.575 | −2.502 | −4.258 | 24.575 | −0.895 | −2.279 | 25.050 |
| −1.234 | −2.848 | 24.575 | −2.502 | −4.258 | 24.575 | −0.901 | −3.950 | 25.050 |
| −1.255 | −4.565 | 24.575 | −2.514 | −4.813 | 24.575 | −0.923 | −4.022 | 25.050 |
| −1.267 | −2.914 | 24.575 | −2.544 | −4.318 | 24.575 | −0.925 | −2.348 | 25.050 |
| −1.288 | −4.632 | 24.575 | −2.553 | −4.750 | 24.575 | −0.946 | −4.094 | 25.050 |
| −1.302 | −2.980 | 24.575 | −2.572 | −4.387 | 24.575 | −0.956 | −2.417 | 25.050 |
| −1.323 | −4.697 | 24.575 | −2.580 | −4.680 | 24.575 | −0.970 | −4.166 | 25.050 |
| −1.337 | −3.045 | 24.575 | −2.588 | −4.459 | 24.575 | −0.987 | −2.486 | 25.050 |
| −1.360 | −4.762 | 24.575 | −2.593 | −4.607 | 24.575 | −0.995 | −4.237 | 25.050 |
| −1.373 | −3.110 | 24.575 | −2.595 | −4.533 | 24.575 | −1.018 | −2.555 | 25.050 |
| −1.399 | −4.825 | 24.575 | −0.433 | −1.811 | 25.050 | −1.021 | −4.308 | 25.050 |
| −1.410 | −3.174 | 24.575 | −0.443 | −1.886 | 25.050 | −1.047 | −4.379 | 25.050 |
| −1.440 | −4.887 | 24.575 | −0.456 | −1.740 | 25.050 | −1.049 | −2.623 | 25.050 |
| −1.448 | −3.238 | 24.575 | −0.457 | −1.960 | 25.050 | −1.076 | −4.449 | 25.050 |
| −1.484 | −4.946 | 24.575 | −0.470 | −2.034 | 25.050 | −1.081 | −2.692 | 25.050 |
| −1.487 | −3.301 | 24.575 | −0.484 | −2.109 | 25.050 | −1.105 | −4.518 | 25.050 |
| −1.527 | −3.363 | 24.575 | −0.498 | −2.183 | 25.050 | −1.113 | −2.760 | 25.050 |
| −1.532 | −5.003 | 24.575 | −0.512 | −2.257 | 25.050 | −1.136 | −4.587 | 25.050 |
| −1.569 | −3.425 | 24.575 | −0.514 | −1.693 | 25.050 | −1.146 | −2.828 | 25.050 |
| −1.584 | −5.056 | 24.575 | −0.526 | −2.331 | 25.050 | −1.169 | −4.655 | 25.050 |
| −1.612 | −3.485 | 24.575 | −0.540 | −2.406 | 25.050 | −1.179 | −2.896 | 25.050 |
| −1.640 | −5.105 | 24.575 | −0.554 | −2.480 | 25.050 | −1.203 | −4.723 | 25.050 |
| −1.656 | −3.545 | 24.575 | −0.569 | −2.554 | 25.050 | −1.213 | −2.964 | 25.050 |
| −1.701 | −5.147 | 24.575 | −0.584 | −2.628 | 25.050 | −1.239 | −4.789 | 25.050 |

-continued

| X | Y | Z | X | Y | Z | X | Y | Z |
|---|---|---|---|---|---|---|---|---|
| −1.702 | −3.603 | 24.575 | −0.588 | −1.687 | 25.050 | −1.247 | −3.031 | 25.050 |
| −1.750 | −3.660 | 24.575 | −0.599 | −2.702 | 25.050 | −1.278 | −4.854 | 25.050 |
| −1.767 | −5.180 | 24.575 | −0.614 | −2.776 | 25.050 | −1.282 | −3.098 | 25.050 |
| −1.800 | −3.715 | 24.575 | −0.629 | −2.850 | 25.050 | −1.318 | −3.164 | 25.050 |
| −1.838 | −5.202 | 24.575 | −0.645 | −2.924 | 25.050 | −1.319 | −4.917 | 25.050 |
| −1.851 | −3.769 | 24.575 | −0.652 | −1.726 | 25.050 | −1.355 | −3.230 | 25.050 |
| −1.904 | −3.821 | 24.575 | −0.661 | −2.998 | 25.050 | −1.363 | −4.979 | 25.050 |
| −1.912 | −5.209 | 24.575 | −0.677 | −3.072 | 25.050 | −1.393 | −3.296 | 25.050 |
| −1.959 | −3.870 | 24.575 | −0.687 | −1.792 | 25.050 | −1.409 | −5.038 | 25.050 |
| −1.986 | −5.202 | 24.575 | −0.693 | −3.145 | 25.050 | −1.431 | −3.361 | 25.050 |
| −2.016 | −3.918 | 24.575 | −0.710 | −3.219 | 25.050 | −1.459 | −5.095 | 25.050 |
| −2.057 | −5.182 | 24.575 | −0.716 | −1.862 | 25.050 | −1.471 | −3.425 | 25.050 |
| −2.075 | −3.964 | 24.575 | −0.727 | −3.293 | 25.050 | −1.512 | −3.489 | 25.050 |
| −2.125 | −5.152 | 24.575 | −0.745 | −3.366 | 25.050 | −1.512 | −5.149 | 25.050 |
| −2.135 | −4.007 | 24.575 | −0.746 | −1.931 | 25.050 | −1.554 | −3.552 | 25.050 |
| −2.189 | −5.114 | 24.575 | −0.762 | −3.439 | 25.050 | −1.569 | −5.198 | 25.050 |
| −2.196 | −4.049 | 24.575 | −0.775 | −2.001 | 25.050 | −1.597 | −3.614 | 25.050 |
| −2.250 | −5.072 | 24.575 | −0.781 | −3.513 | 25.050 | −1.630 | −5.243 | 25.050 |
| −2.259 | −4.089 | 24.575 | −0.799 | −3.586 | 25.050 | −1.641 | −3.675 | 25.050 |
| −2.308 | −5.025 | 24.575 | −0.805 | −2.070 | 25.050 | −1.687 | −3.735 | 25.050 |
| −2.322 | −4.128 | 24.575 | −0.819 | −3.659 | 25.050 | −1.695 | −5.282 | 25.050 |
| −2.363 | −4.976 | 24.575 | −0.835 | −2.140 | 25.050 | −1.734 | −3.794 | 25.050 |
| −2.386 | −4.166 | 24.575 | −0.838 | −3.732 | 25.050 | −1.763 | −5.314 | 25.050 |
| −1.885 | −3.963 | 25.050 | −0.571 | −3.174 | 25.525 | −1.322 | −5.185 | 25.525 |
| −1.910 | −5.349 | 25.050 | −0.588 | −3.250 | 25.525 | −1.337 | −3.437 | 25.525 |
| −1.939 | −4.016 | 25.050 | −0.604 | −3.325 | 25.525 | −1.373 | −3.505 | 25.525 |
| −1.985 | −5.350 | 25.050 | −0.618 | −1.892 | 25.525 | −1.377 | −5.239 | 25.525 |
| −1.995 | −4.067 | 25.050 | −0.621 | −3.401 | 25.525 | −1.409 | −3.574 | 25.525 |
| −2.052 | −4.116 | 25.050 | −0.638 | −3.476 | 25.525 | −1.437 | −5.289 | 25.525 |
| −2.060 | −5.339 | 25.050 | −0.652 | −1.962 | 25.525 | −1.447 | −3.642 | 25.525 |
| −2.112 | −4.162 | 25.050 | −0.656 | −3.552 | 25.525 | −1.485 | −3.709 | 25.525 |
| −2.132 | −5.316 | 25.050 | −0.674 | −3.627 | 25.525 | −1.500 | −5.333 | 25.525 |
| −2.173 | −4.206 | 25.050 | −0.685 | −2.032 | 25.525 | −1.524 | −3.775 | 25.525 |
| −2.200 | −5.284 | 25.050 | −0.692 | −3.702 | 25.525 | −1.565 | −3.841 | 25.525 |
| −2.237 | −4.247 | 25.050 | −0.711 | −3.777 | 25.525 | −1.568 | −5.371 | 25.525 |
| −2.264 | −5.244 | 25.050 | −0.717 | −2.102 | 25.525 | −1.608 | −3.906 | 25.525 |
| −2.302 | −4.285 | 25.050 | −0.731 | −3.852 | 25.525 | −1.638 | −5.403 | 25.525 |
| −2.324 | −5.199 | 25.050 | −0.750 | −2.172 | 25.525 | −1.652 | −3.970 | 25.525 |
| −2.369 | −4.320 | 25.050 | −0.751 | −3.927 | 25.525 | −1.697 | −4.032 | 25.525 |
| −2.380 | −5.148 | 25.050 | −0.771 | −4.002 | 25.525 | −1.711 | −5.429 | 25.525 |
| −2.432 | −5.093 | 25.050 | −0.782 | −2.243 | 25.525 | −1.745 | −4.093 | 25.525 |
| −2.434 | −4.359 | 25.050 | −0.793 | −4.076 | 25.525 | −1.785 | −5.450 | 25.525 |
| −2.481 | −5.035 | 25.050 | −0.815 | −2.313 | 25.525 | −1.795 | −4.152 | 25.525 |
| −2.492 | −4.407 | 25.050 | −0.815 | −4.150 | 25.525 | −1.847 | −4.210 | 25.525 |
| −2.525 | −4.974 | 25.050 | −0.838 | −4.224 | 25.525 | −1.861 | −5.466 | 25.525 |
| −2.536 | −4.468 | 25.050 | −0.847 | −2.384 | 25.525 | −1.902 | −4.264 | 25.525 |
| −2.561 | −4.908 | 25.050 | −0.861 | −4.298 | 25.525 | −1.938 | −5.479 | 25.525 |
| −2.561 | −4.907 | 25.050 | −0.879 | −2.454 | 25.525 | −1.959 | −4.316 | 25.525 |
| −2.567 | −4.537 | 25.050 | −0.886 | −4.372 | 25.525 | −2.015 | −5.486 | 25.525 |
| −2.586 | −4.610 | 25.050 | −0.911 | −2.525 | 25.525 | −2.019 | −4.366 | 25.525 |
| −2.586 | −4.835 | 25.050 | −0.912 | −4.444 | 25.525 | −2.082 | −4.411 | 25.525 |
| −2.596 | −4.685 | 25.050 | −0.939 | −4.517 | 25.525 | −2.092 | −5.487 | 25.525 |
| −2.596 | −4.760 | 25.050 | −0.943 | −2.595 | 25.525 | −2.147 | −4.454 | 25.525 |
| −0.343 | −1.956 | 25.525 | −0.968 | −4.589 | 25.525 | −2.169 | −5.479 | 25.525 |
| −0.353 | −2.033 | 25.525 | −0.975 | −2.666 | 25.525 | −2.213 | −4.493 | 25.525 |
| −0.366 | −1.883 | 25.525 | −0.998 | −4.660 | 25.525 | −2.213 | −4.493 | 25.525 |
| −0.366 | −2.109 | 25.525 | −1.006 | −2.736 | 25.525 | −2.245 | −5.463 | 25.525 |
| −0.380 | −2.186 | 25.525 | −1.030 | −4.731 | 25.525 | −2.283 | −4.527 | 25.525 |
| −0.394 | −2.262 | 25.525 | −1.038 | −2.807 | 25.525 | −2.318 | −5.437 | 25.525 |
| −0.408 | −2.338 | 25.525 | −1.063 | −4.801 | 25.525 | −2.353 | −4.560 | 25.525 |
| −0.421 | −1.830 | 25.525 | −1.070 | −2.878 | 25.525 | −2.386 | −5.400 | 25.525 |
| −0.422 | −2.414 | 25.525 | −1.099 | −4.869 | 25.525 | −2.420 | −4.599 | 25.525 |
| −0.436 | −2.490 | 25.525 | −1.102 | −2.948 | 25.525 | −2.446 | −5.352 | 25.525 |
| −0.450 | −2.566 | 25.525 | −1.135 | −3.018 | 25.525 | −2.479 | −4.648 | 25.525 |
| −0.465 | −2.642 | 25.525 | −1.138 | −4.936 | 25.525 | −2.498 | −5.294 | 25.525 |
| −0.479 | −2.718 | 25.525 | −1.167 | −3.089 | 25.525 | −2.525 | −4.710 | 25.525 |
| −0.494 | −2.794 | 25.525 | −1.179 | −5.002 | 25.525 | −2.539 | −5.229 | 25.525 |
| −0.495 | −1.811 | 25.525 | −1.200 | −3.159 | 25.525 | −2.559 | −4.780 | 25.525 |
| −0.509 | −2.870 | 25.525 | −1.223 | −5.066 | 25.525 | −2.572 | −5.159 | 25.525 |
| −0.524 | −2.946 | 25.525 | −1.234 | −3.229 | 25.525 | −2.581 | −4.854 | 25.525 |

It will also be appreciated that the internal core profile of the nozzle airfoil disclosed in the above table may be scaled up or down geometrically for use in other similar turbine designs. Consequently, the coordinate values set forth in Table I may be scaled upwardly or downwardly such that the internal profile shape of the nozzle airfoil remains unchanged. A scaled version of the coordinates of Table I would be represented by X, Y and Z coordinate values of Table I multiplied or divided by a constant number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine nozzle segment including inner and outer platforms and an airfoil extending between said platforms, said airfoil having an internal nominal core profile at least a portion of which is substantially in accordance with Cartesian coordinate values of X, Y and Z set forth in Table I between Z value limits of 22.200 and 25.050, wherein said Z values between said limits are radial distances from a turbine axis to planes extending normal to the radii and wherein the X and Y values are distances in inches which, when connected by smooth continuing arcs, define internal core profile sections at each distance Z along the airfoil between said Z value limits, the profile sections at the Z distances between said limits being joined smoothly with one another to form said airfoil internal core profile.

2. A turbine nozzle segment according to claim 1 forming part of a first stage of a turbine.

3. A turbine nozzle segment according to claim 1 wherein said internal core profile lies in an envelope within ±0.030 inches in a direction normal to any internal core surface location.

4. A turbine nozzle segment according to claim 1 wherein the X, Y and Z distances are scalable as a function of the same constant or number to provide a scaled-up or scaled-down internal core profile.

5. A turbine comprising a plurality of nozzle segments arranged in a circumferential array about an axis of the turbine, each said nozzle segment including inner and outer platforms and at least one airfoil extending between said platforms, each said airfoil having an internal nominal core profile at least a portion of which is substantially in accordance with Cartesian coordinate values of X, Y and Z set forth in Table I between Z value limits of 22.200 and 25.050, wherein said Z values between said limits are radial distances from a turbine axis to planes extending normal to the radii and wherein the X and Y values are distances in inches which, when connected by smooth continuing arcs, define internal core profile sections at each distance Z along the airfoil between said Z value limits, the profile sections at the Z distances between said limits being joined smoothly with one another to form said airfoil internal core profile.

6. A turbine according to claim 5 forming part of a first stage of a turbine.

7. A turbine according to claim 5 wherein said internal core profile lies in an envelope within ±0.030 inches in a direction normal to any internal core surface location.

8. A turbine nozzle segment including inner and outer platforms and an airfoil extending between said platforms, said airfoil having an internal nominal core profile substantially in accordance with Cartesian coordinate values of X, Y and Z set forth in Table I wherein the Z values are radial distances from a turbine axis to planes extending normal to the radii and wherein the X and Y values are distances in inches which, when connected by smooth continuing arcs, define internal core profile sections at each distance Z along the airfoil, the profile sections at the Z distances being joined smoothly with one another to form said airfoil internal core profile.

9. A turbine nozzle segment according to claim 8 forming part of a first stage of a turbine.

10. A turbine nozzle segment according to claim 8 wherein said internal core profile lies in an envelope within ±0.030 inches in a direction normal to any internal core surface location.

11. A turbine comprising a plurality of nozzle segments in a circumferential array about an axis of the turbine, each said segment having inner and outer platforms and at least one airfoil extending between said platforms, each said airfoil having an internal nominal core profile substantially in accordance with Cartesian coordinate values of X, Y and Z set forth in Table I wherein the Z values are radial distances from said turbine axis to planes extending normal to the radii, and wherein the X and Y values are distances in inches which, when connected by smooth continuing arcs, define internal core profile sections at each distance Z along the airfoil, the profile sections at the Z distances being joined smoothly with one another to form said airfoil internal core profile.

12. A turbine according to claim 11 forming part of a first stage of a turbine.

13. A turbine according to claim 11 wherein said internal core profile lies in an envelope within ±0.030 inches in a direction normal to any internal core surface location.

* * * * *